United States Patent [19]

Simpson et al.

[11] Patent Number: 4,497,151

[45] Date of Patent: Feb. 5, 1985

[54] STANDING SEAM METAL ROOF ASSEMBLY

[75] Inventors: Harold G. Simpson, Oklahoma City, Okla.; Bert D. Hollman, Saint Joe, Ind.

[73] Assignee: Nucor Corporation, Charlotte, N.C.

[21] Appl. No.: 425,477

[22] Filed: Sep. 28, 1982

[51] Int. Cl.[3] ..... E04D 1/34; E04D 3/362

[52] U.S. Cl. ..... 52/520; 52/543; 52/467

[58] Field of Search ..... 52/520, 543, 573, 522, 52/521, 544, 545, 467, 394, 519, 468

[56] References Cited

U.S. PATENT DOCUMENTS

| | | | |
|---|---|---|---|
| 3,481,094 | 12/1969 | Taylor | 52/522 X |
| 3,975,880 | 8/1976 | Fischer | 52/573 X |
| 3,998,019 | 12/1976 | Reinwall | 52/545 |
| 4,034,532 | 7/1977 | Reinwall | 52/520 |
| 4,037,372 | 7/1977 | Patry | 52/573 X |
| 4,102,105 | 7/1978 | Taylor et al. | 52/544 X |
| 4,337,606 | 7/1982 | Reusser | 52/573 |
| 4,361,998 | 12/1982 | Ellison et al. | 52/520 |

*Primary Examiner*—J. Karl Bell

*Attorney, Agent, or Firm*—Shenier & O'Connor

[57] ABSTRACT

A pitched floating standing seam metal roof formed of elongated metal panels. Each panel is provided with an upstanding female side portion and an upstanding male side portion. Adjacent panels are sidelapped and end-lapped. The lapped portions are sealed with a resilient mastic sealant. Means are provided for applying constant pressure to the sealant. The roof is attached to the infrastructure by two-part clips. The lower part of each clip is fixed; the upper part of each clip is provided with means for preventing relative motion of the clip in respect of the roof panels. Each of the panels of the four-corner junction of the lapped standing seam portions is notched. The junction is sealed by a hood which compresses a sealant over the junction.

7 Claims, 11 Drawing Figures

STANDING SEAM METAL ROOF ASSEMBLY

BACKGROUND OF THE INVENTION

Standing seam metal roofs are normally manufactured from metal panels of prepainted steel or aluminum. These panels vary from two to three feet in width and twenty to forty feet in length. In constructing a building, the structural walls or columns of the building are first erected and beams, or trusses, forming the primary roof support are carried by the walls of columns of the structure. These trusses usually extend transverse of the length of the building. The trusses in turn support purlins, or joists. Normally, blankets of insulation are spread across the joists, after which the standing seam roof assembly is constructed. The panels are joined to each other along adjacent sides. In the roof of our invention, these sides are lapped together to form standing seams. The roof assembly must be secured to the infrastructure, and this is done by means of clips which prevent the roof from being blown from the structure. Present-day metal roofs have low slopes, their pitch being roughly in the neighborhood of two to five degrees. Standing seams lend stiffness and strength to the roof structure. The metal roof will expand and contract as a function of the coefficient of expansion of the metal of which the roof is made and the temperature cyles to which it is exposed. It is known, in the prior art, to provide sliding clips to allow relative motion between the roof and the infrastructure, thus permitting the roof to "float". The repeated action of expansion and contraction weakens the panel-to-panel-to-lap joint, sometimes causing structural failure and, frequently, leaks. The leaks are caused by the weakening of the fastening means and working or kneading of the sealant used at the joints. In the prior art, the sealant used required adhesion, flexibility, and water-repellency. The design of the joint was such that in many instances the pressure on the sealant varied greatly throughout the length of the sidelap and endlap joints. The endlap joints were normally located in the lowest part of the panel. In such location, water tended to run directly over the joints. Any deterioration of the sealant in these endlap joints would permit wind gusts to drive water into the joints, causing leakage. At numerous places along the roof, there are areas where two end panels and two adjacent side panels form a four-corner intersection. This area is particularly difficult to seal. Watertightness of the roof has been a recurring problem in standing seam roofs. Very frequently, the air in the interior of the building may be conditioned. In the process of doing this, the atmospheric pressure may become greater than the pressure in the building and rain water running over the roof may be sucked through the endlap. The sidelap has water overlying it less frequently.

FIELD OF THE INVENTION

Our invention relates to an improved standing seam metal floating roof assembly and, more particularly, to the sidelap, endlap, four-corner intersection, and clip construction.

DESCRIPTION OF THE PRIOR ART

Reinwall, Jr. U.S. Pat. No. 3,998,019 shows a clip secured to a purlin with a spring clamp interposed between the purlin and the head of a threaded fastener. The clip is formed with an elongated slot which the fastener passes so as to permit longitudinal motion of the clip in respect of the purlin. There are no means, however, of preventing relative motion between the clip and the standing seam of the metal roof in which the upper portion of the clip is lodged.

Reinwall, Jr. U.S. Pat. No. 4,034,532 shows a two-piece clip for holding a standing seam roof to the infrastructure. Relative motion between the base member and the upper portion of the clip is permitted. However, there is nothing to prevent relative motion between the clip itself and the metal roof.

Taylor et al U.S. Pat. No. 4,102,105 is similar to Reinwall, Jr. '019 and it suffers from the same fault; namely, there are no means for preventing relative motion between the upper portion of the clip and the standing seam of the roof in which it is lodged.

Cummings et al U.S. Pat. No. 4,106,250 shows a sealant, such as mastic 184, in the gap between the male and female portions of the standing seam of a metal roof. There are no means for clamping the sealant between the male and female portions. The configuration would require a relaxation of the pressure for the joints to seat properly. There is no disclosure that the sealant has any resiliency.

Mattingly et al U.S. Pat. No. 4,269,012 shows a standing seam of a metal roof using sealing strips of flexible resilient material, such as polyvinyl chloride or neoprene or "caulking sealant", between the male and female portions of the interfitting members forming the standing seam. There is no disclosure that, after the same is assembled, there is a clamping action of the sealant between the male and female portions.

Yoder, Jr. U.S. Pat. No. 4,168,596 shows a sealant, such as mastic 38 (sheet 3 of 5) in the gap between the two upstanding portions of adjacent standing seam panels forming a metal roof. There is no means for exerting a continuous clamping force on the sealant between the two panel portions. The configuration allows a relaxation of the pressure after the panels are joined. There is no disclosure that the sealant has any resiliency.

SUMMARY OF THE INVENTION

In general, our invention comprises the provision of a sidelap having a snapped-together cross sectional shape composed of male and female members. The sidelap is so constructed that, in addition to adhesion, flexibility, and water-repellency, we use a sealant which has resiliency together with a configuration adapted to exercise substantially uniform continuous pressure against the sealant. This is done in such a manner that the joint mechanism reaches and remains in equilibrium throughout the full length of the joint. In this manner, the sealant acts as a gasket and functions, throughout the life of the panel, to prevent leaks of air and moisture from the exterior into the building protected by the roof. Natural forces, such as changes in temperature, wind uplift, and downwardly directed snow loads, tend to continually move the roof panels in respect of one another. The resiliency of the sidelap mastic and the substantially uniform continuous pressure exerted by the joint on the mastic allows the sidelap to move under these forces without breaking the mastic seal or allowing dirt to be kneaded into the joint.

Clips of the prior art were intended to permit relative motion between the roof and the infrastructure supporting it. Frequently, however, relative movement took place between the upper end of the clip and the metal roof, instead of between the clip and the joist. This movement would tend to weaken, disintegrate, or displace the sealant in the standing seam. We have overcome this problem by preventing relative motion between the metal roof and the upper end of the clip. This constrains the clip to move with the roof, as intended, relative to the joists which support the roof. The endlaps of our invention also clamp the sealant between adjacent ends of the panels.

The four-corner joints, where four panels come together, require both endlap seals and the sealing of the standing seam portion formed by the four corners. We provide each of the panels with notched portions adjacent to their ends. The four-corner joint is formed by the male and female members of one panel in the area of the notches embracing the male and female member in the portions of an adjoining panel. Sealant is provided between the embracing portions and the embraced portions. A compression hood, lined with a sealant, embraces the four-corner joint and is held down by a panel cinch strap. The cinch strap is constructed so that as the fasteners immediately adjacent to the standing seam corrugation are tightened, they exert a downward pressure on the cinch strap. In this process the mastic in the cup is forced into the separations between the upstanding panel edges thus forming a watertight dam at the four-corner splice. Because of the geometry of the panel overlap, the mastic is extruded into all of the separations. This creates a watertight dam between the endlap sealant and the sealant in the standing seam portion. Placing the sealant in the cup eliminates a difficult field quality control placement problem. This cinch strap extends over the lap joints and serves to form one member of a clamp together with a panel backup plate which forms the other clamped member. The arrangement is such that the four-corner joint is securely sealed at the standing seam portion and at the endlap by the clamping action thus achieved.

Our clip comprises a base member which is secured to a joist. A sliding clip portion is mounted on the base for movement at right angles to the joist, the clip being secured in the upper standing seam portion between the male and female members. The clip holds the roof against a horizontal portion which is provided with projections adapted to bite into the metal of the roof, thus preventing relative motion between the clip and the roof. This constrains the clip to move relative to its base carried by the joist. The clip portion between the male and female members is encapsulated by sealant.

OBJECTS OF THE INVENTION

One object of our invention is to provide a sidelap joint for adjacent panels of a standing seam metal roof in which a resilient sealant is clamped under substantially uniform continuous spring pressure between male and female members without the aid of a field-seaming machine or the necessity of assembling and rotating the panel being assembled into a pre-designated position.

Another object of our invention is to provide an endlap joint between adjacent panels of a metal roof which can be located at any point between adjacent supporting joists or purlins.

Still another object of our invention is to provide a four-corner assembly for sealing the standing seam of a metal roof formed by the junction of four adjacent roof panels.

A further object of our invention is to provide a clip for holding a metal roof to a supporting infrastructure in which relative motion between the clip and the metal roof is prevented while permitting relative motion between the clip and the infrastructure.

Other and further objects of our invention will appear from the following description.

BRIEF DESCRIPTION OF THE DRAWINGS

In the accompanying drawings, which form part of the instant specification and which are to be read in conjunction therewith, and in which like reference numerals are used to indicate like parts in the various views.

DESCRIPTION OF THE PREFERRED EMBODIMENT

Figure 1:
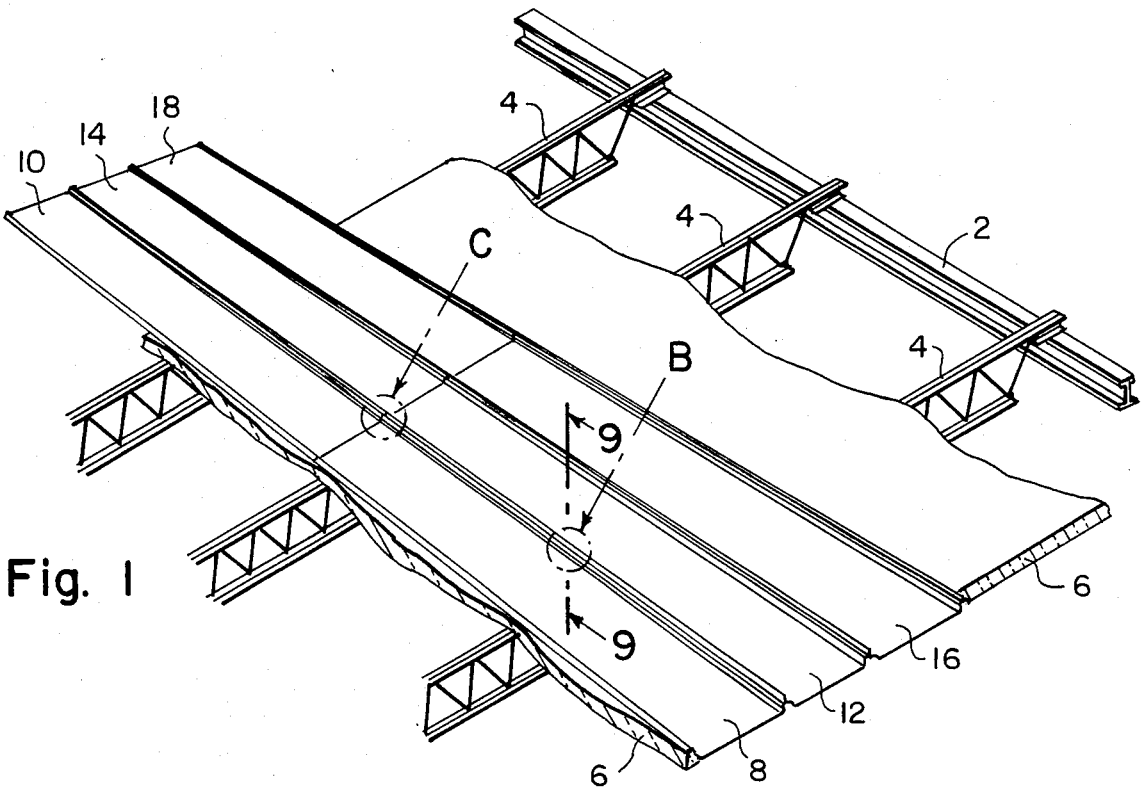
FIG. 1 is a perspective view, with parts broken away, of a portion of a metal roof assembly.
Figure 2:
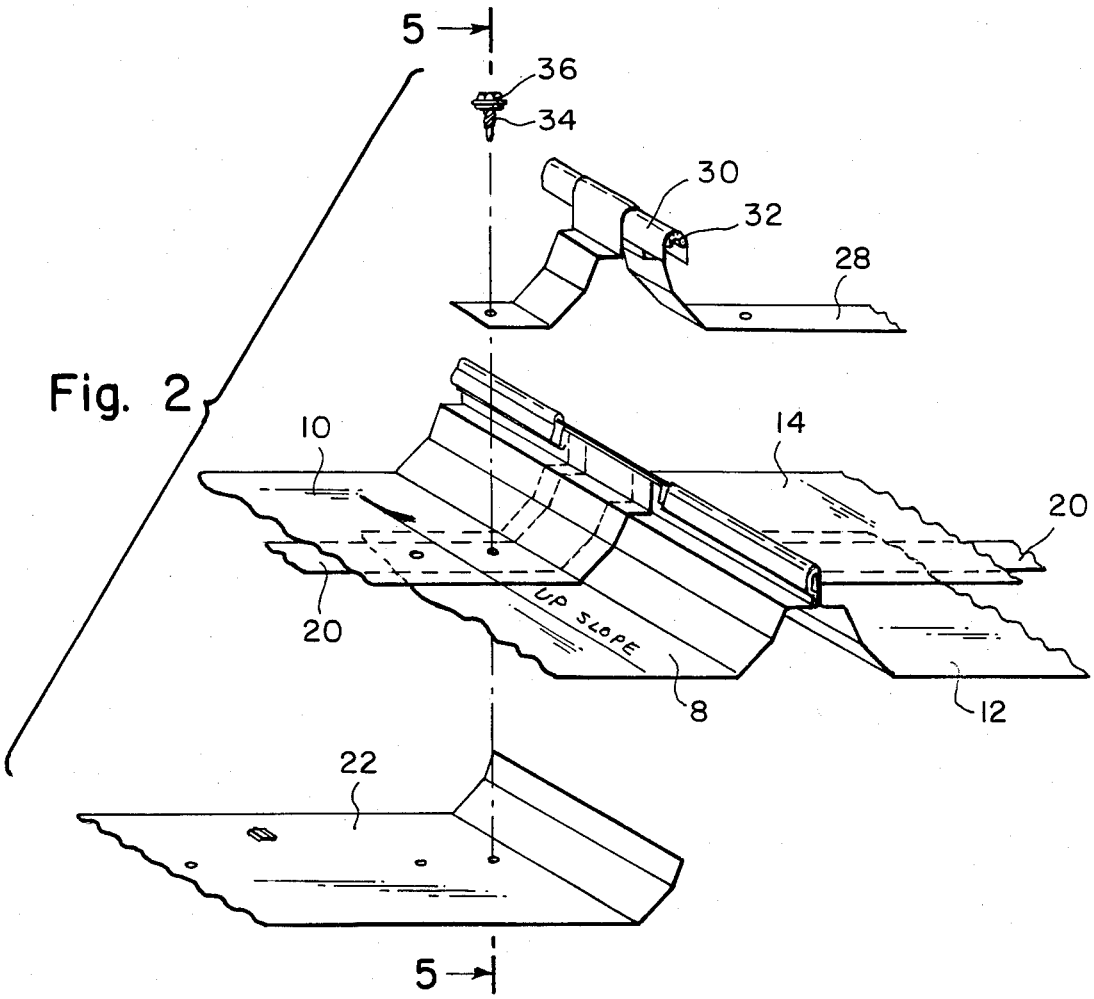
FIG. 2 is an exploded view showing an endlap and a four-corner junction of four adjacent panels, fragments of which are shown.

More particularly, referring now to FIG. 1 of the drawings, a beam or truss 2 is supported by the walls of a building (not shown). Purlins or joists 4 extend from beam 2 to a companion beam (not shown). The joists support insulating batts 6 which may be formed of any suitable insulating material, such s Fiberglas, Styrofoam, or the like. Roof panels 8 and 12 are joined by a sidelap, shown in greater detail in FIG. 6. Roof panels 8 and 10 are joined at their adjacent short ends by the endlap construction shown in detail in FIGS. 2 and 5. Panels 10 and 14 are joined along their sides by a sidelap similar to the junction of panels 8 and 12. The four corners of the junction of panels 8, 10, 12 and 14 in the standing seam portion are associated by the junction of our invention. Panels 12 and 14 are joined at their short ends in the same manner as panels 8 and 10. It is to be understood that other panels 16 and 18 are joined to panels 12 and 14, as are panels 8 and 12 and 10 and 14.

Figure 3:
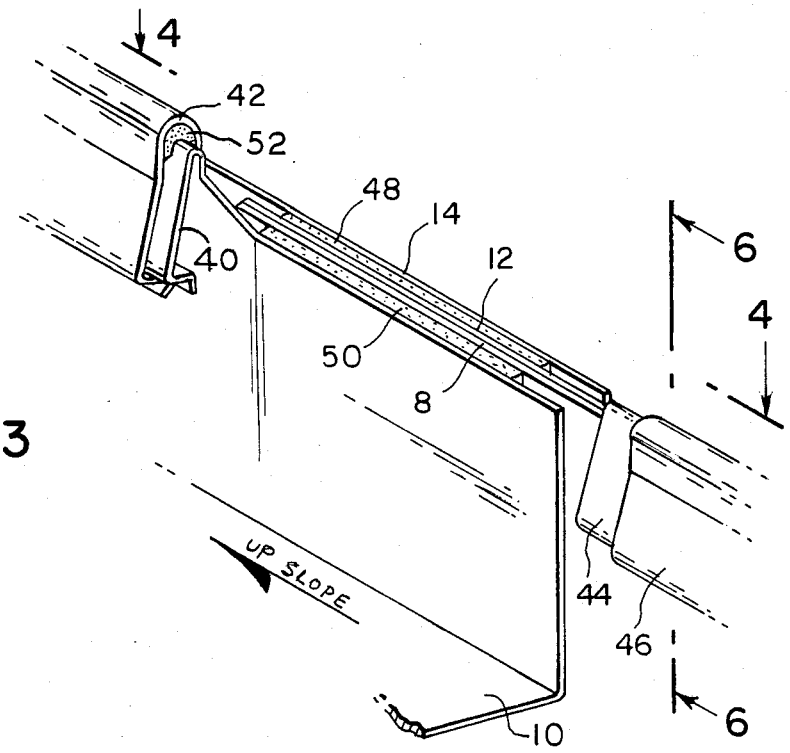
FIG. 3 is a perspective view, drawn on an enlarged scale with parts broken away, showing a portion of a four-corner junction of a standing seam at area C in FIG. 1.

In the prior art, the sealant was usually a mastic which had the qualities of adhesion, flexibility, and water-repellency. Any resiliency which the mastic had was purely accidental. In fact, in many cases mastic resiliency in the sidelap was detrimental because the joint did not exert a uniform pressure and any resiliency tended to accentuate the non-uniform pressure and forced the panels apart at critical points. The sealant was designed to remain in place by adhesion. In contrast to this, in our invention, we clamp the sealant between two members of the construction. Considering first the endlaps or junctions, and referring more particularly to FIGS. 2 and 5, panel 8 is lapped by panel 10, and panel 12 is lapped by panel 14, and a sealant strip 20 is placed between overlapping panels. Panels 8 and 10 and 12 and 14 have endlap factory-punched holes. The position of these holes is coordinated to ensure the overlap is such that upstanding flange 8 and 12 overlap upstanding flanges 10 and 14 by an amount that ensures mastics 48 and 50, as seen in FIG. 3, are brought into proper relationship while at the same time upstanding flanges 8 and 12 remain separated from male corrugation 40 by an amount sufficient to allow mastic 32 to be extruded into the panel separations as the cinch strap, mastic cup and mastic are installed. This enables mastic 32 to seal this joint. It is understood, of course, that the sidelaps between panels 8 and 12 and 10 and 14 have been completed. The order of assembly is panel 8, followed by panel 10, and then followed by panel 12 and panel 14. After the placement of panel 8 has been accomplished, and before panel 10 is placed, a backup plate 22 is placed under the end junction of panel 8. A similar backup plate (not shown) is placed under the end junction of panels 12 before panel 14 is placed.

Figure 5:
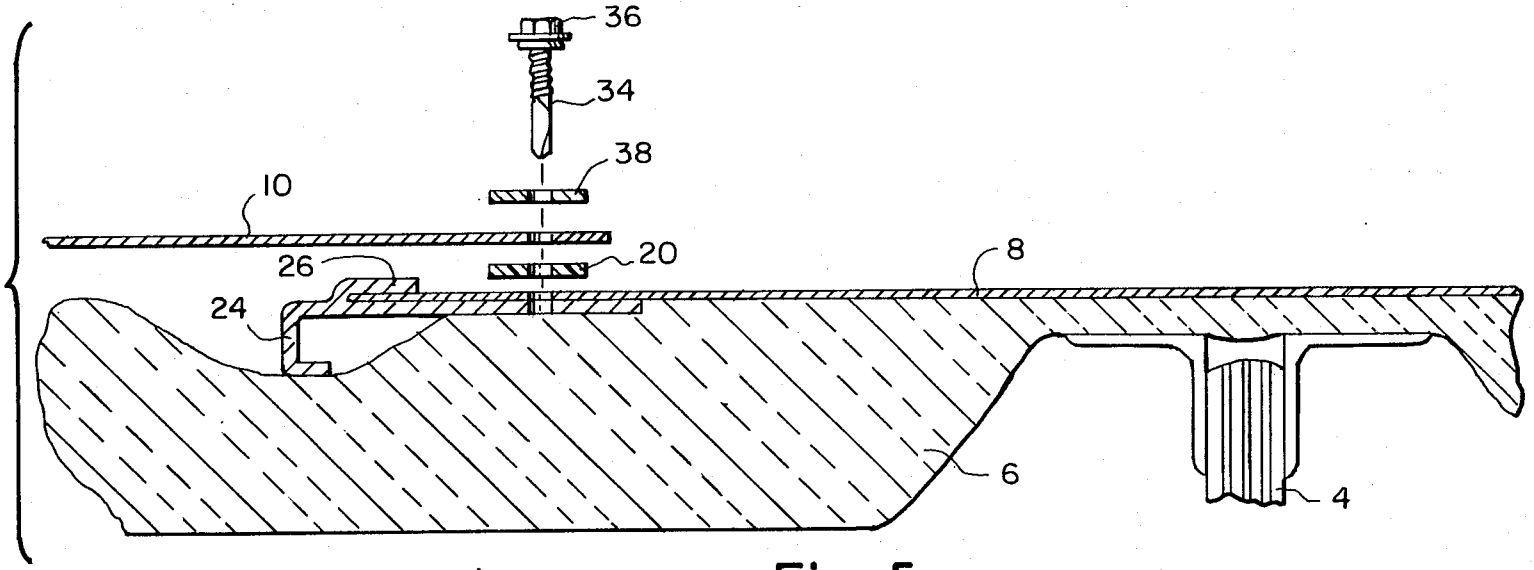
FIG. 5 is an exploded sectional view, drawn on an enlarged scale, taken along the line 5—5 of FIG. 2.

Referring now to FIG. 5, a backup fitting 24 is formed with an integrally raised member 26 forming a recess into which the end of the roof panel 8 passes. Backup fitting 24 is constructed so that it is clipped onto panel 8 and remains there without aid or support from the adjacent joist while the endlap assembly is completed.

Referring again to FIG. 2, a cinch strap 28 embraces a compression hood 30 which is lined with sealant in the form of non-resilient tape mastic 32. This mastic being of a composition that will deform and extrude into the gaps between overlapped panel edges in the notched area of the endlap.

Figure 4:
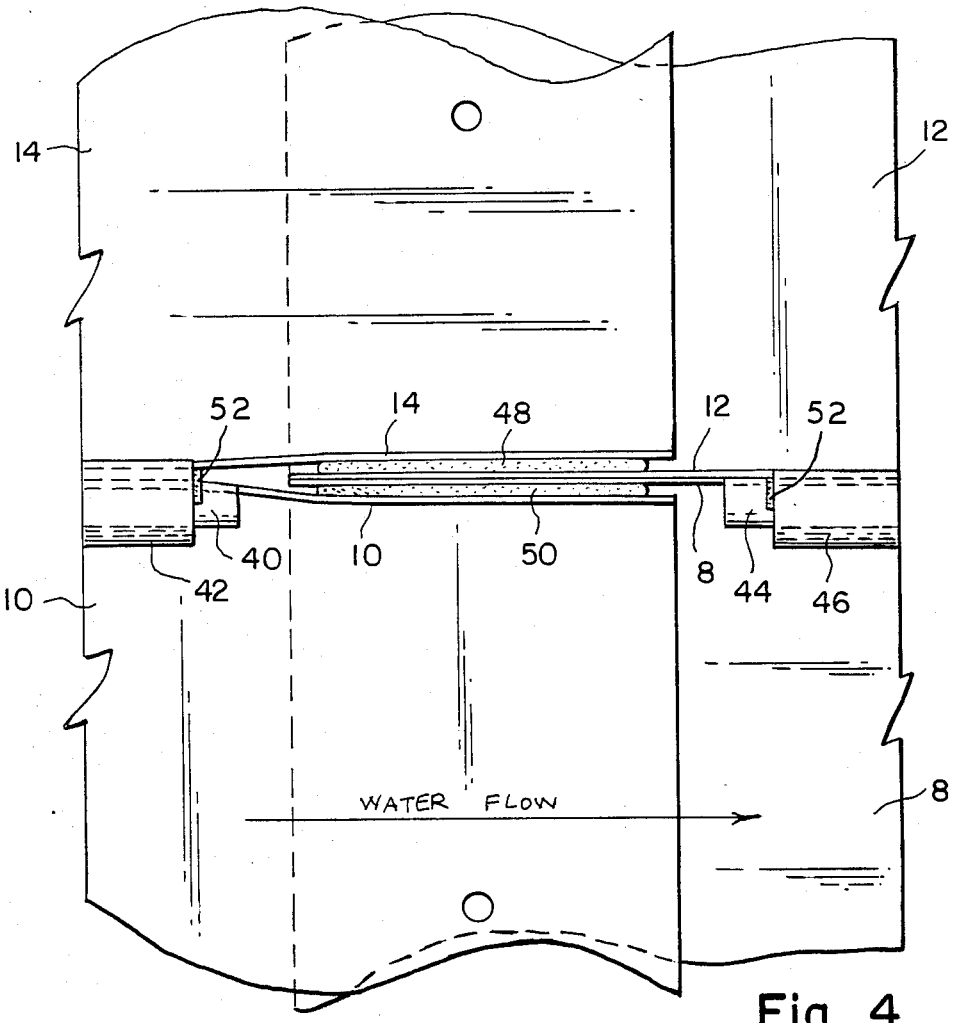
FIG. 4 is a plan view, drawn along the line 4—4 of FIG. 3.

Referring again to FIG. 5, a self-tapping screw 34 is provided with a head 36 adapted to coact with a neoprene washer 38. The fasteners are adapted to secure the assembly and clamp the resilient mastic tape 20 between panels 8 and 10 and panels 12 and 14. At the same time, the compression hood 30 and its non-resilient tape 32 will be clamped over the four-corner junction shown in FIGS. 3 and 4, to which reference is now had.

It will be observed, by reference to FIG. 3, that panel 10 is formed with a male portion 40 and panel 14 is formed with a female portion 42. Similarly, panel 8 is formed with a male portion 44 and panel 12 is formed with a female portion 46. It will also be observed, by reference to FIG. 3, that the ends of panels 8, 10, 12, and 14 have been notched. The relation between these notches when assembled in the field is controlled by aligning and inserting a fastener through the factory-punched hole in the panel endlap. In the construction shown, panels 8 and 12 are adjacent to each other and extend to within panels 10 and 14. Sealant 48 is placed between panels 12 and 14, while sealant 50 is placed between panels 8 and 10. The compression hood 30 covers the notched portions and seals the entire assembly at the four-corner junction. The endlap mastic 48 and 50 are exposed at that juncture as is standing seam sealant 52 which protrudes slightly from the cavity formed by the top of the male corrugation 44 and the bottom of the female corrugation 46. Resilient mastic 52 is compressed, forced to protrude and faces upward. This enables it to contact mastic 32 when assembled. The end of the male corrugation 44 protrudes slightly past the end of the female corrugation 46. This causes extruded standing seam mastic 52 to force upward so it will make contact with cup mastic 32 and sealants 48 and 52 to form a watertight four-corner joint.

Figure 7:
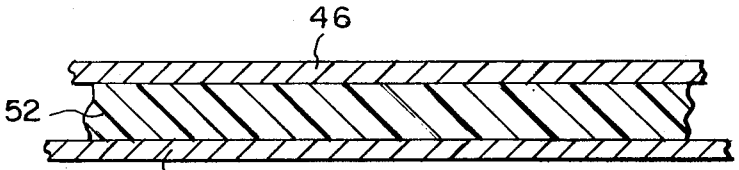
FIG. 7 is a fragmentary sectional view, drawn along the line 7—7 of FIG. 6.
Figure 6:
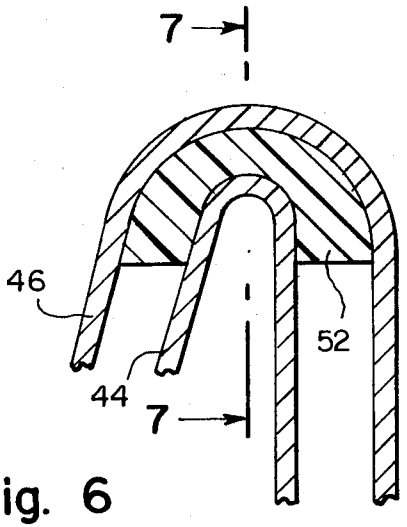
FIG. 6 is a partial sectional view, drawn on an enlarged scale, taken along the line 6—6 of FIG. 3.

Referring now to FIGS. 6 and 7, it will be seen that standing seam sealant 52 is shown in detail in these figures. We have described this sealant as having not only adhesion, flexibility, and water-repellency, but also resiliency. The sealant which we use has a rubber-like quality and, advantageously, may be that sold under the trademark of "Q-41" Q'SO Incorporated of Saginaw, Tex. It is a blend of cross-linked ethylene-propylene terpolymer and other materials such as plasticizer and antioxidants. It is to be understood that the sealant must have the qualities of adhesion, flexibility, water-repellency, and resiliency in order that it may be compressed to form a gasket. Standing seam mastic 52 is preferably a foamed mastic which has a substantially constant durometer. A constant durometer assures easy field assembly of the panel throughout a wide range of field temperatures.

Figure 9:
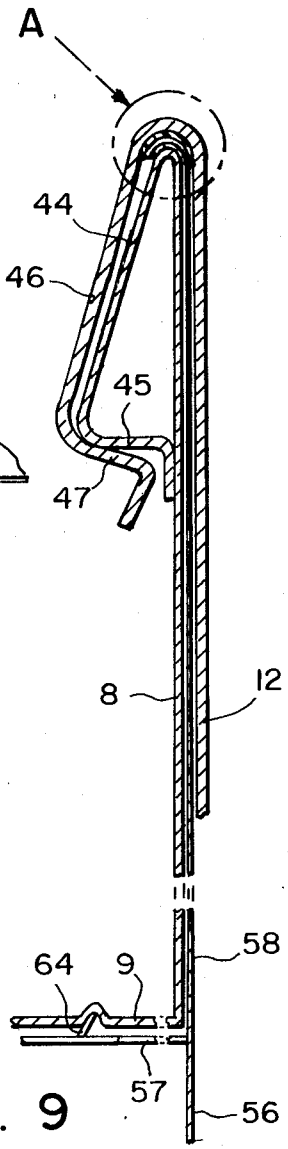
FIG. 9 is a fragmentary sectional view, drawn on an enlarged scale, taken along the line 9—9 of FIG. 1.
Figure 10:
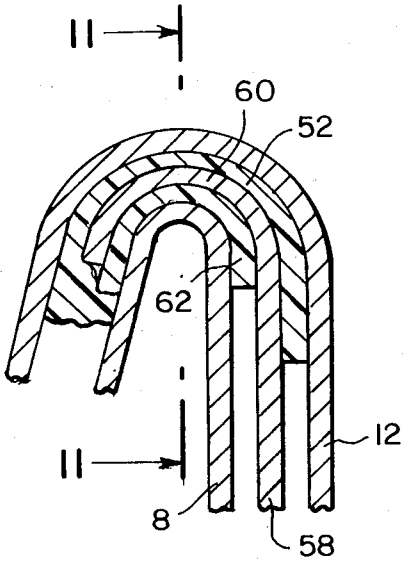
FIG. 10 is a view, drawn on an enlarged scale, of the area A shown in FIG. 9.

Referring now to FIG. 9, it will be observed that the female portion 46 of panel 12 forming the standing seam is provided with an extension 47 and that the male portion 44 of panel 8 is likewise provided with a substantially horizontal extension 45. Female extension 47 is configured so that radius of extension 45 will ride up the incline of extension 47 as the panels are snapped together. This coordinated action being such to drive the top of the male corrugation against the mastic and create substantially uniform pressure against the mastic for the full length of the joined sidelap. The arrangement is such that, when the male and female portions are snapped together in assembling adjacent panels, the female portion is clamped upwardly and snaps back, while the extension 47 of the female member exerts spring pressure upwardly against the extension 45 of the male member. This clamps the sealant positioned in the area indicated generally by the arrow A against the curvatures of the male and female portions. This sealant 52 is seen in FIGS. 6 and 10.

Figure 8:
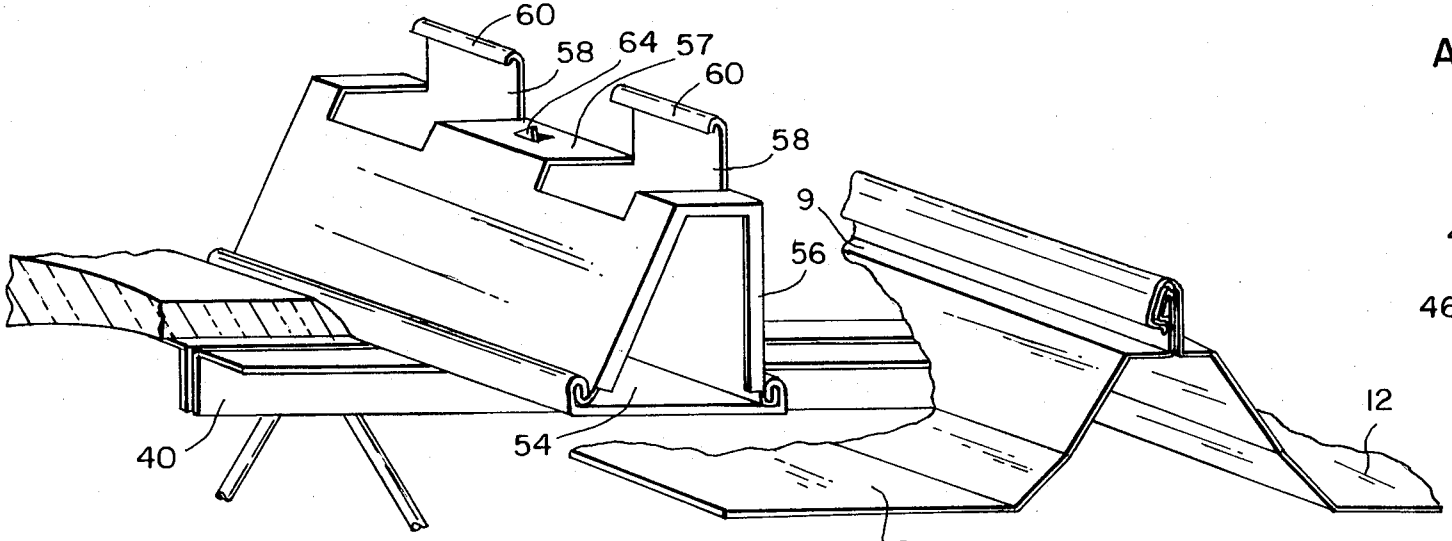
FIG. 8 is a perspective view, with parts broken away, of the area B shown in FIG. 1, illustrating the clip permitting the roof to float.

Referring now to FIG. 8, a base member 54 is secured to joist 4 in the appropriate manner. Slidably mounted in the base member 54, we provide a clip member 56. The clip member 56 has a pair of upwardly extending portions 58 provided with curved end portions 60.

Figure 11:
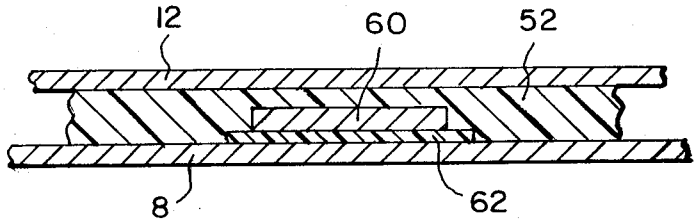
FIG. 11 is a fragmentary sectional view, taken along the line 11—11 of FIG. 10.

Referring again to FIG. 9, the clip portion 58 extends upwardly between the standing seam portions of panels 8 and 12 and curves around where the male and female portions curve downwardly. A tape 62 is positioned between the curved end 60 of the clip portion 58. The arrangement is such that curved portion 60 is encapsulated by the sealant 52 and the tape 62, as can be readily seen by reference to FIG. 11.

Referring again to FIG. 8, the panel 8 is formed with a substantially horizontal portion 9 adapted to seat upon horizontal portion 57 of the clip element 56. The horizontal portion or shelf 57 is provided with a projection 64 adapted to bite into the horizontal portion 9 of the panel 8. When the panels are assembled, the projection 64 bites into the panel 8 and prevents the panel from moving relative to the clip element 56 formed integrally with the upstanding clip portion 58 housed between the standing seam assembly.

In forming our improved standing seam metal floating roof assembly, we employ self-tapping screws. It is to be understood that compressible washers are placed below the heads of these screws wherever they are used. These washers are resilient. This prevents dimpling of the panel in the areas immediately around the fastener and avoids pockets in which water may stand. The prevention of relative motion between the clip and the panels forming the standing seam overcomes the working, kneading, or degrading of the sealant. In our construction, all sealants are kept under constant slight uniform pressure and dirt is prevented from reaching past the outside line of the sealants. It has been the experience in the art that most standing seam roofs fail because they develop leakage at the joints which do not remain sealed.

It will be further observed that, wherever sealant is applied, dirt, oil, or film may intervene between the sealant and the panel metal itself. We prefer to use the sealant in the form of mastic tapes having not only adhesion, but also resiliency. The placing of the mastic at the point of panel rotation allows the panels to be assembled, when they are snapped together, in a manner such that the sealant is not dislodged. The sealant, furthermore, has a tendency to become compressed because of repeated roof live loads, such as workers walking on the roof, snow, and the like. With the advent of lower-pitched roofs, it is more common for persons to walk on the roof. Furthermore, snow and ice tend to stay on the roof to a much greater extent than with the higher-pitched roofs formerly used. Under these conditions, the sealing function becomes extremely important in the life of the roof. The thickness of the mastic sealant tapes should be sufficient to resist movement caused by expansion and contraction and various live-load conditions without rupturing.

It will be seen that we have accomplished the objects of our invention. We have provided a sidelap joint for adjacent panels of a standing seam metal roof in which a resilient sealant is clamped under spring pressure between male and female members, as well as an endlap joint between adjacent panels in which a sealant is clamped between the upper and lower panels. Our novel four-corner assembly enables us to seal the standing seam roof at this junction and ensure that no leakage will occur at this point. We have provided a novel clip for holding the metal roof to the infrastructure such that the roof may float relative to the infrastructure while preventing relative motion between the roof and the clip.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. In a standing seam floating roof assembly a pair of metal panels, each having elongated side portions and shorter end portions, one of said side portions being formed with an upwardly directed male standing seam section and the other of said side portions being formed with an upwardly directed female standing seam section, said male section having a downwardly directed part and said female section having a downwardly directed part, each of said downwardly directed parts having a substantially horizontal component, the horizontal component of the female portion positioned out of contact with the downwardly directed part of the male portion, adjacent panels positioned with said male and female sections being interlocked with the horizontal component of said female section contacting the horizontal component of said male section and urging it upwardly, a resilient sealant positioned at the uppermost portion of the standing seam formed by said male and female sections, the construction being such that said sealant is clamped between said male and female sections by the horizontal component of the female portion.

2. In a standing seam floating roof assembly a pair of metal panels, each having elongated side portions, one of said side portions being formed with an upwardly directed male standing seam section and the other of said side portions being formed with an upwardly directed female standing seam section, adjacent panels positioned with said male and female sections being interlocked to form a standing seam, in infrastructure adapted to support said roof assembly, a clip having a base and an upper part, said upper part being slidably mounted in said base, means for securing said base to said infrastructure, said upper part of said clip being lodged between said male and female sections, and means carried by the clip for positively engaging a metal panel to prevent relative motion between said clip and said metal panel.

3. In a standing seam floating roof assembly a pair of metal panels, each having elongated side portions, one of said side portions being formed with an upwardly directed male standing beam section and the other of said side portions being formed with an upwardly directed female standing seam section, said male section having a downwardly directed part and said female section having a downwardly directed part, each of said downwardly directed parts forming an apex, adjacent panels positioned with said male and female sections being interlocked, a resilient sealant positioned between said apexes, a clip having a base and an upper part, an infrastructure adapted to support said base, said upper part being slidably mounted in said base, means for securing said base to said infrastructure, the upper part of said clip being lodged between said male and female sections with the upper piece of said clip being positioned between the outer side of the male apex and the inner side of the female apex, sealant placed on both sides of said upper clip piece, and means for clamping said sealant between the outer side of the male apex and the inner side of the female apex.

4. A standing seam floating roof assembly as in claim 3 including means carried by the clip for preventing relative motion between the upper clip part and one of said roof metal panels.

5. In a standing seam floating roof assembly two pairs of metal panels, each having elongated side portions and shorter end portions, one of each of said side portions being formed with an upwardly directed male standing seam section and the other of each of said side portions being formed with an upwardly directed female standing seam section, each of said male sections having a downwardly directed part and each of said female sections having a downwardly directed part, adjacent panels positioned with said male and female sections being interlocked, the end portions of adjacent panels being overlapped, a strip of resilient sealant being positioned between the overlapping end portions, a backup plate carried solely by the underlying panel positioned under the lower end portion of each pair of panels, a cinch strap positioned over the upper end portion of each pair of panels, and means including said backup plate and said cinch strap for clamping said resilient sealant between said panels.

6. In a pitched standing seam floating roof assembly two pairs of metal panels, each having elongated side portions formed with upwardly directed standing seam sections, the two lower metal panels being positioned adjacent to each other with their standing seam sections interlocked, the two upper metal panels being positioned adjacent to each other with their standing seam sections interlocked, the upper ends of the two lower metal panels being overlapped by the lower ends of the two upper metal panels, thus forming a junction of four panels, the upper portions of the standing seam sections being notched in the area of said junction, a sealant positioned between each lower standing seam section and its overlapping upper standing seam section, a compression hood adapted to fit over said junction, a sealant positioned at the inside of said compression hood and forming a continuous dam, and means for compressing said hood against the junction of said four panels.

7. A standing seam roof assembly as in claim 6 in which said standing seam is formed by male and female sections, the male section extending longitudinally beyond said female sections in said notched area.

* * * * *

UNITED STATES PATENT AND TRADEMARK OFFICE

CERTIFICATE OF CORRECTION

PATENT NO. : 4,497,151

DATED : February 5, 1985

INVENTOR(S) : Harold G. Simpson and Bert D. Hollman

It is certified that error appears in the above–identified patent and that said Letters Patent are hereby corrected as shown below:

Column 8, line 31, "beam" should read -- seam --.

Signed and Sealed this

*Eleventh* Day of *June 1985*

[SEAL]

*Attest:*

DONALD J. QUIGG

*Attesting Officer* *Acting Commissioner of Patents and Trademarks*